United States Patent [19]

Mancini

[11] Patent Number: 4,913,240

[45] Date of Patent: Apr. 3, 1990

[54] MACHINE TO CLEAN AND REHABILIATATE RAILWAY BALLAST AND RAILWAY ROAD BEDS

[75] Inventor: Flavio Mancini, Brescia, Italy

[73] Assignees: Danieli & C. Officing Mecanich SpA; ITI/CLM Impianti Tecnica industrili SpA, both of Buttrio, Italy

[21] Appl. No.: 217,967

[22] Filed: Jul. 12, 1988

[30] Foreign Application Priority Data

Jul. 22, 1987 [JP] Japan ..... 83409 A/87

[51] Int. Cl.[4] ..... E01B 27/00

[52] U.S. Cl. ..... 171/16

[58] Field of Search ..... 171/16; 104/2, 3, 5, 104/6, 7 R, 12

[56] References Cited

U.S. PATENT DOCUMENTS

| | | | |
|---|---|---|---|
| 2,737,901 | 3/1956 | Drouard | 171/16 |
| 3,976,142 | 8/1976 | Pleasser et al. | 171/16 |
| 4,094,249 | 6/1978 | Theurer | 171/16 |
| 4,479,439 | 10/1984 | Theurer | 171/16 |
| 4,640,364 | 2/1987 | Theurer | 171/16 |

FOREIGN PATENT DOCUMENTS

| | | | |
|---|---|---|---|
| 0184236 | 6/1986 | European Pat. Off. . | |
| 3528152 | 2/1986 | Fed. Rep. of Germany | 171/16 |
| 2518602 | 6/1983 | France . | |
| 2063971A | 6/1981 | United Kingdom | 171/16 |

*Primary Examiner*—Robert E. Garrett
*Assistant Examiner*—Therese M. Newholm
*Attorney, Agent, or Firm*—Wegner & Bretschneider

[57] ABSTRACT

Machine to clean and rehabilitate railway ballast and railway road beds, which can: (1) remove the ballast, clean the ballast and then replace the ballast, or (2) remove the old ballast and replace it with new ballast. The machine, while riding on the railroad tracks, can remove the metalling of the ballast from the railroad track, then run the material through a riddle to clean the metalling, and finally replace the material. Alternatively, the machine may remove the metalling, then by reversing the direction of a distrubution conveyor, the machine can replace the old metalling with entirely new metalling brought to the distribution conveyor by various feed conveyors. In this alternative mode of operation, the machine can lay a two layered ballast consisting of two different materials.

7 Claims, 4 Drawing Sheets

MACHINE TO CLEAN AND REHABILIATATE RAILWAY·BALLAST AND RAILWAY ROAD BEDS

This invention concerns a machine to clean and rehabilitate railway ballast and railway road beds. To be more exact, the invention concerns a cleaning machine which is known in itself and can also perform rehabilitation operations on the railway road bed when necessary in ground having special characteristics.

Such rehabilitation operations are carried out with known and already existing devices on the cleaning machine in conjunction with additional devices suitable for the purpose; such additional devices may be always comprised on the machine or be only included momentarily for rehabilitation work.

Machines for the cleaning of railway ballast of the type, for instance, disclosed in Italian patent application No. 83440 A/84 of the present applicant are known.

Machines are also known which rehabilitate continuously the railway road bed in ground having a particular composition, for instance, of a clayey type. Such rehabilitation consists in excavating a channel in the upper part of the railway road bed and backfilling suitable material, normally a mixture of sand and gravel, in the channel.

The material excavated together with the metalling of the previous ballast is removed.

The ballast is renewed with new metalling after the backfill material has been deposited in the excavation.

The machines of the prior art are intended for only one type of operation and can perform either the cleaning alone or the rehabilitation alone.

The present applicants have studied, tested and embodied in machine able to carry out both cleaning and rehabilitation work.

The basic machine is a cleaning machine of a known type which cooperates functionally with additional means suitable to rehabilitate the railway road bed. Such additional means may be always comprised on the machine and may cooperate momentarily with the means of the cleaning machine in rehabilitation operations alone.

According to a variant the additional means are comprised only during rehabilitation work.

Such additional means consist of elements for the delivery to the machine of backfill material for the road bed and of metalling received from storage wagons connected to the machine.

Means are included to distribute the materials delivered to the machine and to pass such materials to differentiated usage sites.

The means to distribute and pass the backfill material cooperate with distribution means already comprised in the known formation machine, such latter distribution means moving during rehabilitation in a direction opposite to that carried out during cleaning work alone.

A compaction assembly cooperates with an excavation device in the excavation made.

Differentiated assemblies are also included for the even distribution and levelling of the backfill material deposited in the excavation in the road bed and of the metalling deposited on the road bed.

The invention is therefore embodied according to the contents of claim 1 and the dependent claims.

The attached figures, which are given as a non-restrictive example, show the following:

Figure 3:
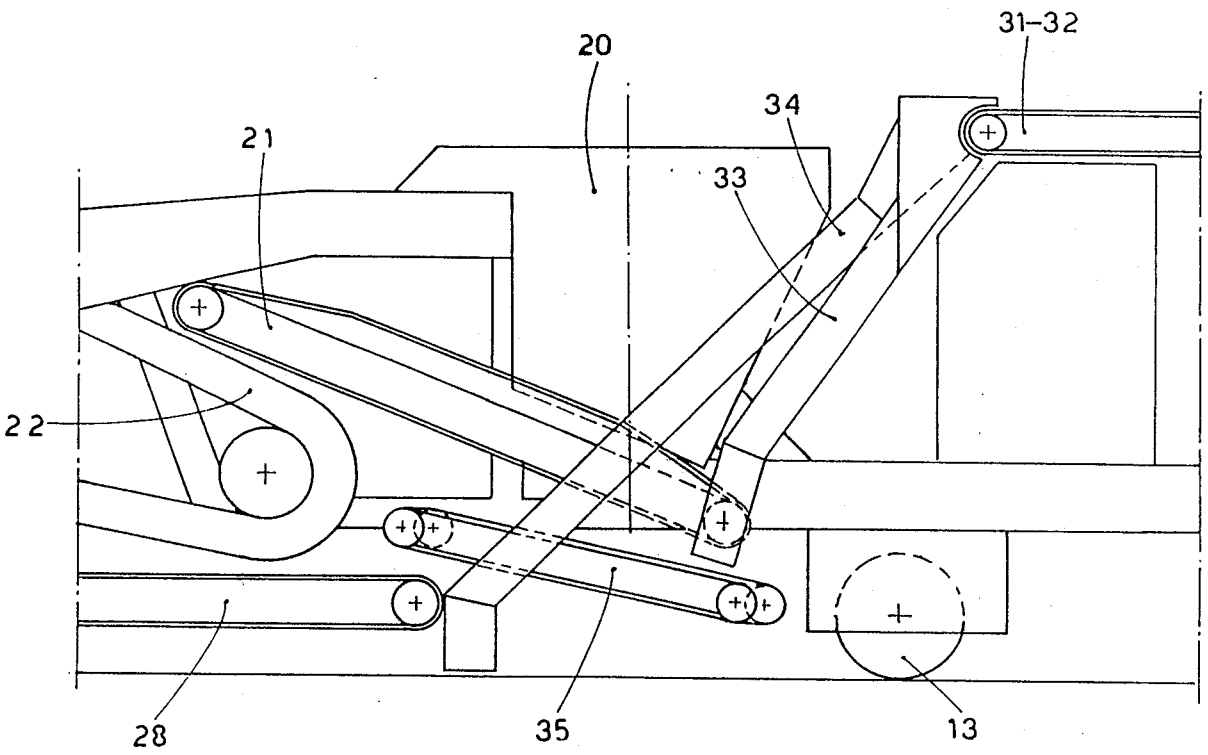
Figure 4:
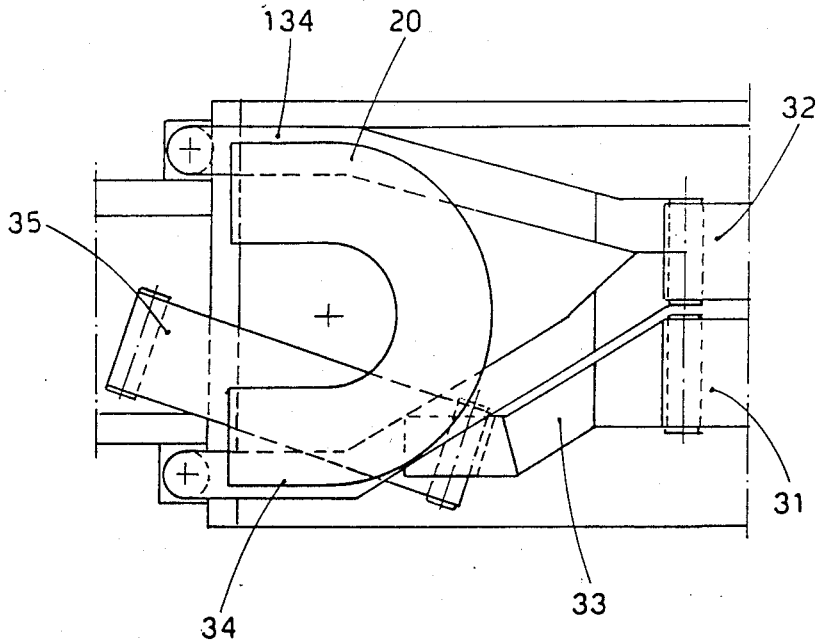
Figure 5:
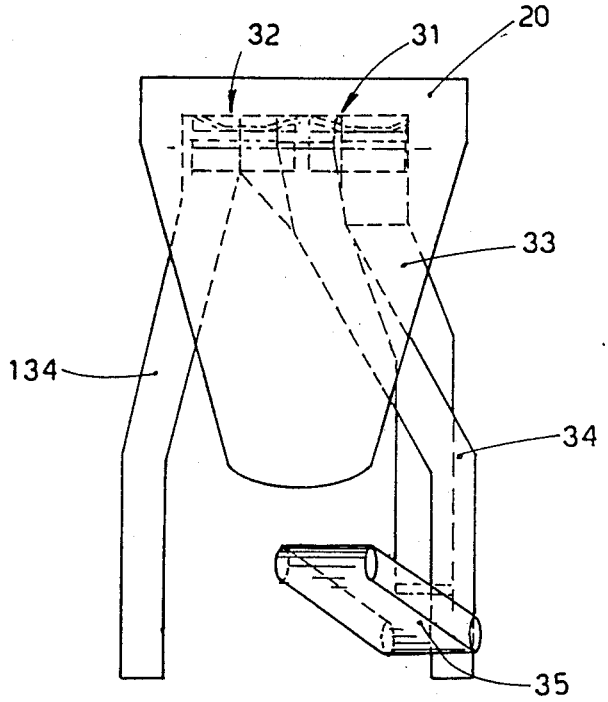

FIG. 3 gives a diagrammatic side view of an embodiment of the means distributing the materials fed to the cleaning and rehabilitation machine according to the invention;

FIG. 4 is a view of the distribution means of FIG. 3 from above;

FIG. 5 is a front view of the distribution means of FIG. 3.

Figure 1:
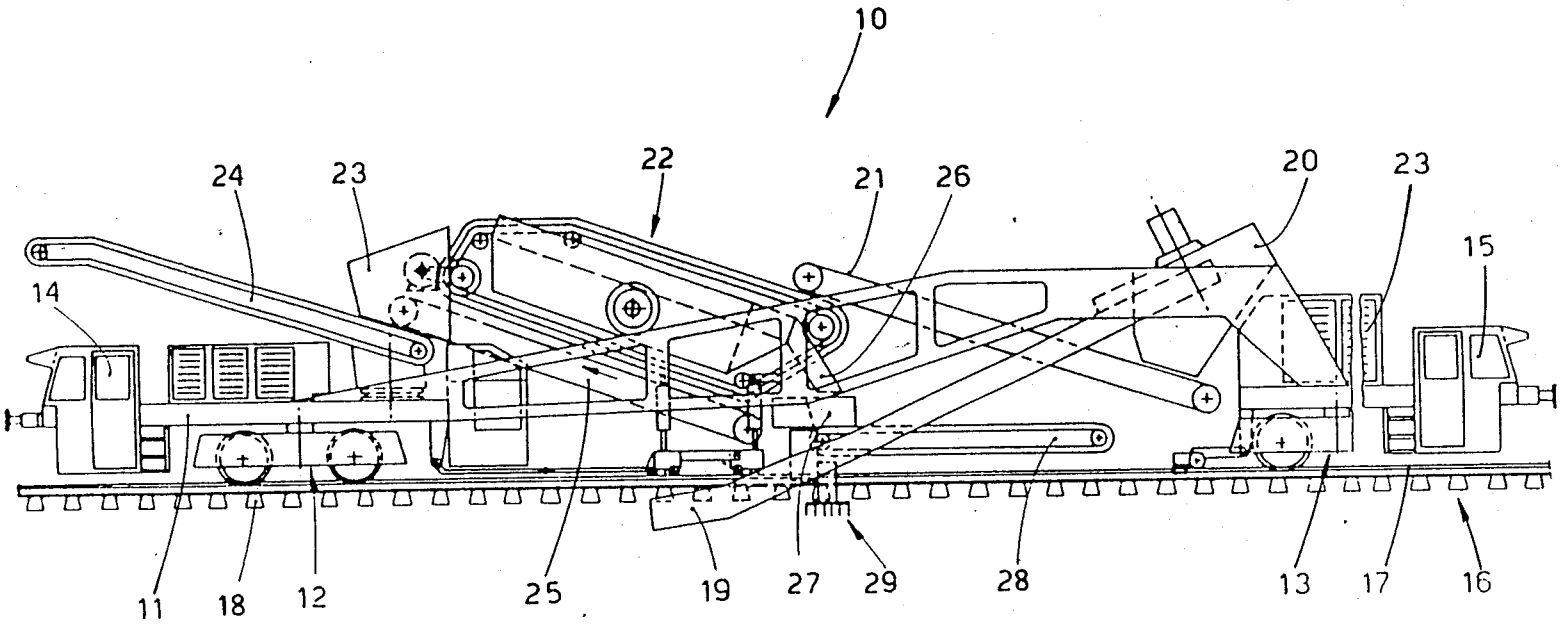
fig. 1 PRIOR ART
FIG. 1 shows diagrammatically a cleaning machine of a known type.

FIG. 1 shows diagrammatically a formation machine 10 of a known type for railway ballast. This means 10 comprises a framework 11 rested in this example on a front bogie 12 and a rear bogie 13.

Two cabs 14-15 to drive the machine during travelling are provided at the ends of the machine. The figure shows a railway line 16 with rails 17 and sleepers 18.

The machine 10 comprises an excavation chain 19 cooperating with a first hopper 20 in transferring the excavated material on a first elevator 21 to a riddle 22, which in this example is a continuous endless conveyor riddle.

Means to discharge material, such as a discharge hopper 23, discharge conveyor 24 and a second elevator 25, are included in cooperation with the riddle 22.

The references 26, 27, 28 and 29 indicate respectively a terminal chute or funnel, a distributor hopper, a rear orientable conveyor and a lateral discharge outlet for metalling which is recycled during the cleaning operations as being re-usable.

Means (not shown in FIG. 1) to distribute metalling on the ballast cooperate with the rear conveyor 28.

Figure 2:
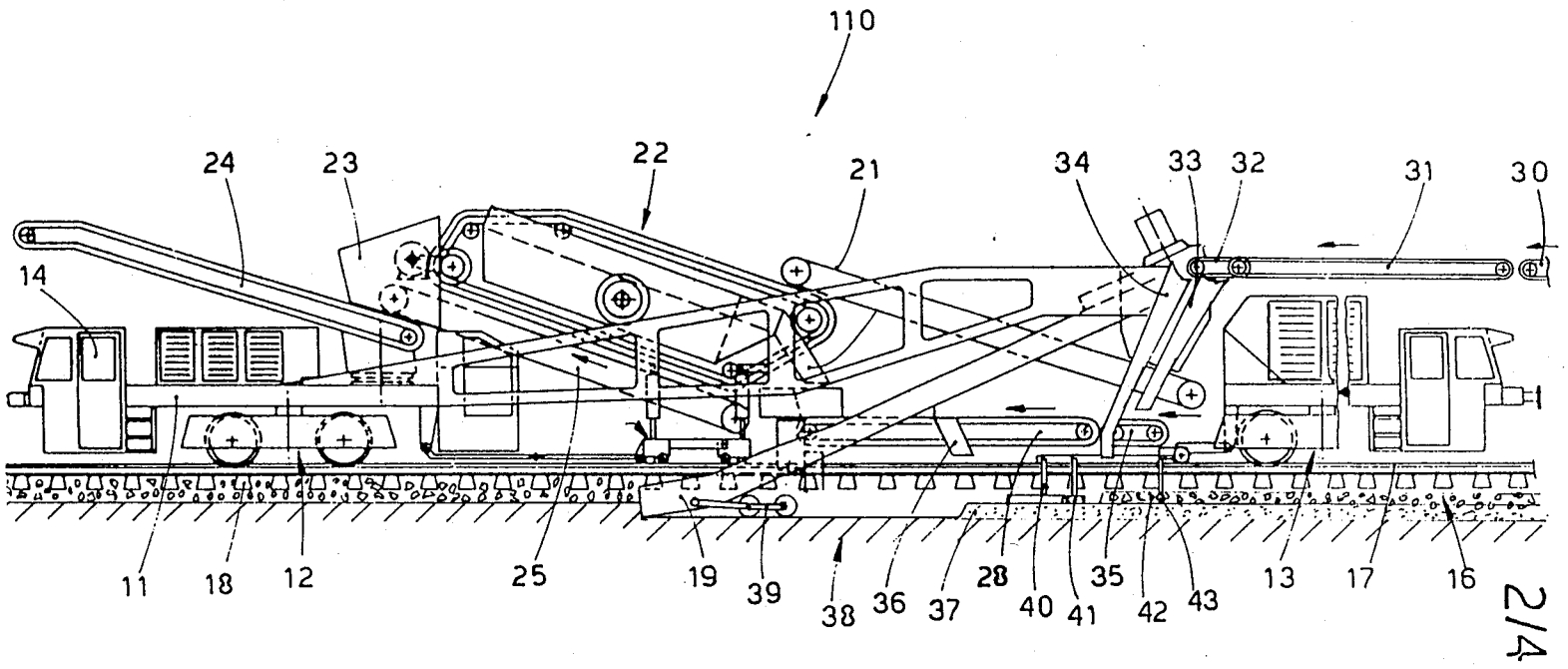
FIG. 2 shows diagrammatically an embodiment of a formation and rehabilitation machine according to the invention.

FIG. 2 shows an embodiment of the cleaning machine of FIG. 1 with preferred embodiments applied to devices suitable for rehabilitation of the railway road bed.

The backfill material and metalling coming from storage wagons connects to the cleaning and rehabilitation machine 110 arrive separatly at such machine 110 by means of feed conveyors 30. These materials are fed into transfer conveyors 31 and 32 integrally fixed to the machine 110 for the transfer of backfill material and metalling respectively.

A distributor chute 33 cooperating with the first transfer conveyor 31 releases backfill material 37 onto an intermediate conveyor 35, which in turn transfers the material onto the rear conveyor 28.

The rear conveyor 28 comprises means 36, chutes for instance, located at the two sides of the rear conveyor 28 for discharge of material.

In the event of rehabilitation work the rear conveyor 28 is made to move in the opposite direction to that of cleaning work, i.e., the conveyor 28 during rehabilitation work moves in the direction of the arrow in FIG. 2.

In this way the backfill material 37, as shown in FIG. 2, is spread continuously on the bottom of an excavation 38 also shown in FIG. 2.

A compaction assembly 39 consisting of at least one roller to level the bottom of the excavation 38 is connected to the excavation chain 19; the roller may be provided with a vibration system of the type, for instance, having out-of-balance bodies or the like.

In rehabilitation operations the excavation chain 19 performs the excavation and transfer of the excavated material and metalling on the first elevator 21 to the second elevator 25, the riddle 22 remaining excluded from work.

The material is passed from the second elevator 25 to the discharge hopper 23 and thence to the discharge conveyor 24.

The cleaning and rehabilitation machine 110 comprises integrally means 40 to perform even spreading or levelling, such as a plough or the like, which operate on the backfill material 37 deposited on the bottom of the excavation.

Compaction means 41, advantageously of a vibration type, cooperate with the levelling means 40 and work in succession thereto in compacting the levelled backfill material 37.

Discharge chutes 34 and 134 cooperating with the second transfer conveyor 32 release their respective material, in this case metalling 42 as shown in FIG. 2, directly onto the compacted backfill material 37.

Means 43 to spread the metalling 42 evenly are fixed integrally to the machine 110 and may consist, for instance, of one or more elements arranged crosswise to the bed of metalling 42 discharged by the discharge chute 34.

FIGS. 3, 4 and 5 give different diagrammatic views of a possible embodiment of the means which distribute the backfill material 37 and metalling 42; the figures show in particular the arrangement of the distributor chute 33 and discharge chutes 34-134 in relation to the first hopper 20.

I claim:

1. Machine to clean and rehabilitate railway ballast from a railroad bed, comprising:

(A) excavating means for removing ballast material from the railroad bed whereby an excavation is formed;

(B) cleaning means for cleaning the ballast material excavated by the excavating means;

(C) rehabilitation means, said rehabilitation means comprising:

(1) transport means for receiving and transporting ballast material, and (2) distribution means for receiving ballast material from the transport means and distributing ballast material within the machine; and (D) first backfill means for replacing the ballast material removed by the excavating means in the excavation;

wherein the first backfill means receives ballast material from one of the cleaning means and the distribution means for backfilling the excavation with ballast material.

2. Machine to clean and rehabilitate railway ballast from a railroad bed as in claim 1, wherein the rehabilitation means further comprises:

(3) first compaction means for compacting a bottom of the excavation, (4) leveling means for leveling the ballast material discharged onto a bottom of the excavation, and (5) second compaction means for compacting the ballast material discharged onto the bottom of the excavation.

3. Machine to clean and rehabilitate railway ballast from a railroad bed as in claim 1, wherein the first backfill means comprises a rear conveyor and a discharge means for discharging the ballast material into the excavation.

4. Machine to clean and rehabilitate railway ballast from a railroad bed as in claim 3, wherein rear conveyor transports ballast material in a first direction during ballast cleaning and transports ballast material in a direction opposite the first direction during rehabilitation.

5. Machine to clean and rehabilitate railway ballast from a railroad bed as in claim 2, wherein the rehabilitation means is removably affixed to the machine.

6. Machine to clean and rehabilitate railway ballast from a railroad bed as in claim 2, wherein the rehabilitation means is nonremovably affixed to the machine.

7. Machine to clean and rehabilitate railway ballast from a railroad bed as in claim 4, wherein the transport means comprises:

first transport conveyor for receiving backfill material;

transfer means for transporting backfill material from the first transport conveyor to the rear conveyor;

second transport conveyor for receiving metalling; and second backfill means for receiving metalling from the second transport means and placing the metalling into the excavation.

* * * * *